US005513605A

United States Patent [19]

Weldon

[11] Patent Number: 5,513,605

[45] Date of Patent: May 7, 1996

[54] COOLED RAILPLUG

[75] Inventor: William F. Weldon, Austin, Tex.

[73] Assignee: Board of Regents, The University of Texas System, Austin, Tex.

[21] Appl. No.: 294,175

[22] Filed: Aug. 22, 1994

[51] Int. Cl.[6] ..... F02P 23/00

[52] U.S. Cl. ..... 123/143 B

[58] Field of Search ..... 123/143 B, 169 EL, 123/169 EB, 169 EC, 149 A, 620, 297; 313/143, 141, 142, 231.41; 315/58

[56] References Cited

U.S. PATENT DOCUMENTS 5,076,223 12/1991 Harden et al. ..... 123/143 B
5,211,142 5/1993 Matthews et al. ..... 123/143 B
5,272,415 12/1993 Griswold et al. ..... 315/58
5,371,436 12/1994 Griswold et al. ..... 315/58
5,377,633 1/1995 Wakeman ..... 123/297

*Primary Examiner*—Raymond A. Nelli
*Attorney, Agent, or Firm*—Arnold, White & Durkee

[57] ABSTRACT

The railplug is a plasma ignitor capable of injecting a high energy plasma jet into a combustion chamber of an internal combustion engine or continuous combustion system. An improved railplug is provided which has dual coaxial chambers (either internal or external to the center electrode) that provide for forced convective cooling of the electrodes using the normal pressure changes occurring in an internal combustion engine. This convective cooling reduces the temperature of the hot spot associated with the plasma initiation point, particularly in coaxial railplug configurations, and extends the useful life of the railplug. The convective cooling technique may also be employed in a railplug having parallel dual rails using dual, coaxial chambers.

12 Claims, 6 Drawing Sheets

PRIOR ART

COOLED RAILPLUG

The Government has certain rights in the present application pursuant to a grant from the Department of Energy, contract no. DE-FG05-91ER12115.

BACKGROUND OF THE INVENTION

The present invention relates to an improved ignitor of combustible mixtures in engines. More specifically, the present invention relates to an improved, more durable railplug ignition device that allows significant cooling of the railplug electrodes.

The railplug is a miniaturized railgun that has been developed for use as an ignitor for internal combustion engines. See Harden et al. U.S. Pat. No. 5,076,223, issued Dec. 31, 1991; and Matthews et al. U.S. Pat. No. 5,211,142, issued May 18, 1993. The railplug uses electromagnetic (EM) forces to inject a plasma into a combustion chamber, thereby creating a turbulent plume that acts as a line source for ignition, as opposed to the point source that a conventional spark plug produces. This results in a faster pressure rise during combustion, leading to a better ability than conventional spark plugs to burn mixtures that are difficult to ignite.

FIG. 1 is a cross-sectional illustration of a prior art coaxial railplug as disclosed by Harden et al. The railplug 18 comprises electrodes, or "rails," enclosed in a cavity or chamber similar to the barrel of a gun. In the particular embodiment disclosed in FIG. 1, outer electrode 20 and inner electrode 22 are substantially parallel to each other. Outer electrode 20 is substantially cylindrical in shape and centered around a central longitudinal axis of the inner electrode 22. Outer and inner electrodes 20 and 22, respectively, of railplug 18 are contained within holding plug 24 and surrounded by insulating sleeve 26. Sleeve 26 is substantially cylindrical in shape and electrically isolates outer electrode 20 from holding plug 24. Insulating ring 32 between inner electrode 20 and outer electrode 22 maintains spacing between the electrodes.

Railplug 18, contained within holding plug 24, is designed to open into combustion chamber 30. Like a standard spark plug, holding plug 24 can be threaded into cylinder head 31. Once in place, holding plug 24 provides a connecting interface between railplug 18 and combustion chamber 30. Combustion chamber 30 can be any chamber in which a combustible mixture or medium resides, and for which ignition of that mixture or medium can take place, such as an internal combustion engine or a continuous combustion system. Specific engines and systems include automotive engines with pistons and cylinders, turbine engines, jet engines, etc.

To establish an electromagnetic field, a current path I is shown in FIG. 1 as entering outer electrode 20 and exiting inner electrode 22. A pulsed current source (not shown) is coupled to railplug 18 and provides the necessary current. When a sufficiently high voltage is applied across the rails to electrically break down the gap between them, an arc jumps cross the rails. To complete the current path, arc 34 forms between outer and inner electrodes 20 and 22. During each current pulse, arc 34 begins at plasma initiation point 36 (defined by protrusions 37 and initiation gap 36 at the distal or remote end of railplug 18) and travels towards muzzle end 38 of railplug 18. The action of the current flowing down one rail, across the arc, and back up the other rail produces a magnetic field. The theory is the same as that which describes the magnetic field created in a solenoid. The electromagnetic force or Lorentz force that accelerates the plasma is a consequence of the interaction of the self-induced magnetic field with the current carriers (electrons and positive ions) in the plasma arc.

In FIG. 1, the direction of the magnetic field is perpendicular to the plane of the paper, into the paper below the center electrode 22 and out of the paper above it. The electron flow is up one rail, across the arc, and down the other rail. This current loop results in the Lorentz force, which may be expressed by:

$$F=qv\times B \tag{1}$$

where F is the force exerted on a charged particle, q is the charge of the particle, v is the velocity of the particle, and B is the strength of the local magnetic flux density. Alternatively, the electromagnetic force acting on the plasma may be expressed as $$F=\tfrac{1}{2}L'I^2 \tag{2}$$

where L' is the inductance gradient or inductance per unit length of the rails and I is current.

FIG. 2B is a cross-sectional view of an alternative prior art embodiment of a railplug. Coaxial railplug 18B comprises outer electrode 20B and inner electrode 22B placed substantially parallel to each other in the bore region from plasma initiation point 35B to muzzle end 38B. Outer electrode 20B is substantially cylindrical in shape and centered around a central axis extending along inner electrode 22B. In the bore region between plasma initiation point 35B and muzzle end 38B, the electrodes are separated from each other by air gap 85. Outer electrode 20B is insulated from holding plug 24B along bore 40B from muzzle end 38B to connection point 86 by air gap 81. At connection point 86, outer electrode 20B is electrically connected to holding plug 24B. It is preferred that the distance S from connection point 86 and plasma initiation point 36B be at least equal to diameter D of bore 40B, and preferably two to three times that diameter. Additionally, it is preferred that the spacing W between outer electrode 20B and inner electrode 22B be approximately equal to the radius of bore 40B, through which the plasma travels from initiation end 36B to muzzle end 38B.

In FIG. 2B, sleeve 26B is substantially cylindrical in shape and electrically isolates inner electrode 22B, which is connected to conductive rod 82, from holding plug 24B. Bushing 84 is threaded into holding plug 24B to retain sleeve 26B. Conductive cap 80 is threaded into sleeve 26B, and is electrically connected to conductive rod 82, and thereby to inner electrode 22B. Other suitable mechanical connections between bushing 84 and holding plug 24B, and also between conductive cap 80 and sleeve 26B, may also be used.

FIG. 2A illustrates a prior art dual-rail railplug 18A, which comprises a pair of substantially parallel electrodes 20A and 22A. Plasma initiation gap 35A is formed by protrusions 37A at the distal end of the chamber formed by bore 40A. Plasma is accelerated from distal or initiation end 36A through gap 35A to muzzle end 38A. Electrode 22A is electrically connected to holding plug 24A at connection point 21A, which is behind plasma initiation point 36A (away from muzzle end 38A).

Several characteristics of railplugs make them promising as engine ignitors. The ability to take full advantage of an electromagnetic force to accelerate the plasma is the most obvious of these. In contrast to other advanced ignitors, thermal expansion augments but does not dominate the jet ejection forces of the railplug. The railplug is designed to maximize the integrated J×B product to accelerate the plasma. In addition, the self-induced magnetic field results in an inherently simple design which will enhance reliability and manufacturing economy. Furthermore, since the arc is not stationary as in the case of a plasma jet ignitor, substantial reductions in electrode erosion are contemplated.

Another strong advantage of the railplug over combustion jet or torch ignitors is that it is not necessary to purge the railplug cavity or chamber or to supply fresh mixture—the plasma is created from whatever molecules are present in the railplug cavity at the time of ignition. A further advantage of the railplug is that it generates a relatively large mass of plasma since the arc sweeps down the rails, ionizing essentially all of the gas in its path.

The railplug has been fabricated with dual electrodes in the form of both coaxial and parallel electrodes. FIGS. 2 and 2A show cross-sections of each of these two geometries, respectively, as described in U.S. Pat. No. 5,211,142. It has been found that the coaxial plug is easier to fabricate, as it does not require a complex insulation scheme and because all of its parts are axisymmetric. Commercially available ceramic tubes may be used to insulate the coaxial plug's inner electrode from its outer one. Two nested, staggered tubes may be used to reduce the risk of tracking failure between electrodes. The plug's axisymmetry means that the rear half of the plug may be made identical to a conventional spark plug, and may thus be easily terminated to fit a standard spark plug connector.

The parallel electrode railplug, on the other hand, requires a ceramic sleeve or sidewall 32A as an insulator that is more complex in shape and cannot be easily modified to avoid tracking failures. Further, its lack of symmetry does not make it as easily adaptable to the standard spark plug envelope. However, as discussed below, the structure of the parallel electrode railplug renders it less susceptible to thermal erosion.

For some applications, it may be preferred that one of the electrodes be grounded. In such applications, as illustrated in FIGS. 2, 2A and 2B, the grounding point (21, 21A, 86) is preferably located behind plasma initiation point (36, 36A, 36B) to help avoid balancing the electromagnetic forces acting on the plasma and thus canceling the Loreritz force. In both geometries shown in FIGS. 2 and 2A, one of the rails is grounded to the plug's outer shell 24, 24A, 24B—similar to the manner in which a conventional spark plug is grounded—as opposed to bringing two electrical connections out of the back of the plug. This helps prevent shorting between the electrodes at the high voltages required to break down the gap at elevated pressures (e.g., greater than 18 kV). Also, these designs use an initiation point (36, 36A, 36B) to help ensure that the break down takes place at the same point each time. This may be a welded point, a reduced diameter, a ground flat, or any feature that reduces the gap clearance or increases the electric field stresses such that electrical breakdown occurs preferentially at that point.

The rails or electrodes of the railplug are typically nickel or tungsten with a diameter ranging from 0.040 to 0.100 inch. Tungsten is a particularly suitable material because tungsten welding electrodes are readily available and have a very high melting point, but other materials with high heat transfer characteristics may be suitable as well. The outer electrode or rail in the coaxial railplug configuration is typically brass or steel. Rail lengths in both designs are on the order of 0.5 inch, although other lengths will be apparent to those of skill in the art.

Although the coaxial railplug may be easier to fabricate and adapt for use in conventional spark plug environments, its natural compensation means that it suffers from a relatively low inductance gradient (L'). Typical L' values for the coaxial plug range from about 0.18 to 0.25 μH/m while a typical number for the parallel rail plug configuration is around 0.30 μH/m. The difference could be even greater were it not for the fact that the parallel rails are shielded by the outer shell, which is typically designed to fit a standard 14 mm thread.

Further, the coaxial plug's cantilevered center electrode has relatively poor heat transfer characteristics as compared to the parallel design, where both rails are in intimate contact with surrounding material. This may be an important design parameter from a durability standpoint, as erosion rates increase at higher electrode temperatures.

The foregoing is provided by way of background only. The general state of the art of railplugs is described more fully in the following publications, which are incorporated herein by reference: Harden et al. U.S. Pat. No. 5,076,223, issued Dec. 31, 1991; Matthews et al. U.S. Pat. No. 5,211,142, issued May 18, 1993; R. Faidley, M. Darden and W. Weldon, "The Railplug: A New Ignitor for Internal Combustion Engines," presented at the Sixth EML Symposium, Austin, Tex. (April 1992); R. Matthews et al., "Further Analysis of Railplugs as a New Type of Engine Ignitor," *SAE International Fuels and Lubrication Meeting and Exposition,* No. 922167 (Oct. 19–22, 1992).

Railplugs have several characteristics that are attractive from the standpoint of combustion ignitors: (1) the energy is deposited over a large surface area; (2) the arc is accelerated down the rails leaving little time available for erosion; (3) the arc is initiated with currents equivalent to those of spark plugs (i.e., the plasma initiation gap 35, 35A, 35B is about the same as a spark gap, or smaller) and then the current is ramped up to higher levels as the arc accelerates down the rails; and (4) suitable materials can be used near the distal or breech end (i.e., the plasma initiation end) of the railplug where wear rates are highest.

Of the railplug configurations described in U.S. Pat. Nos. 5,076,223 and 5,211,142, the coaxial geometry (FIGS. 1, 2, 2B) seems to be the most compatible with present spark plug manufacturing techniques. It also appears to be the least sensitive to contamination of the insulator. However, it has now been discovered that heating of the unsupported center electrode can present a problem. Heat deposited in the center electrode by joule heating and arc heating can be removed only by convection to the surrounding gases and by conduction down the length of the electrode. Unfortunately, enlarging the center electrode diameter to improve the thermal conduction path also decreases the induction gradient of the railplug, which in turn reduces the kinetic velocity achieved for a given current.

Thus, one of the major issues recently discovered in the development of railplugs for commercial applications is the durability of plug electrodes. Presently, plug life in the coaxial design is limited to roughly $10^6$ shots. Failure of a plug may be defined as a shorting out of the plug, whether this is due to a tracking failure or a distortion in the shape or position of the center electrode such that it touched the outer electrode (in a coaxial configuration). Plug failure may also be defined as a failure to consistently ignite a mixture. In general, failed plugs exhibit large amounts of erosion around the initiation point, and if the center electrode actually breaks it typically will be in this region.

This thermal management problem in the coaxial design appears to be compounded by the fact that the heating is not uniform along the length of the center electrode, but is concentrated near the arc initiation point where the arc dwells for the longest time. This localized heating results in accelerated erosion of center electrode material at this point leading to premature failure of the railplug.

Specifically, failure of the coaxial railplug is generally known to occur due to material removal from the center rail beginning at the plasma initiation point and extending to a location about 3–4 mm downstream, with almost no erosion further downstream and no significant wear on the outer rail. It is believed that the center rail is becoming too hot in this high erosion region.

Thus, it is desired to have a railplug geometry that incorporates the advantages of the railplug design, but overcomes the thermal management problems described above.

SUMMARY OF THE INVENTION

The problems outlined above are addressed by the present invention, which represents an improvement on the basic railplug with the object of controlling heat build-up in railgun ignitors, and especially in the center electrode of the coaxial railplug design.

The present invention comprises in a broad aspect a cooled railgun ignition device for generating and injecting a high energy plasma jet into a combustion chamber. The railplug ignitor preferably has dual cavities or chambers that are axially aligned and separated by a narrowed neck. The narrowed neck serves as the hot spot or initiation point. One of the cavities or chambers is designated as proximal in that it opens into a combustion chamber of an internal combustion engine. The other cavity or chamber is referred to as distal in that it extends away from the combustion chamber and is closed at its distal end.

The cooled railgun device includes first and second spaced apart electrodes extending along a central axis and defining a bore having a proximal, or muzzle end and a distal, or insulator end. A plasma initiation point is located in the bore between and spaced from the proximal end and the distal end, and an extended or second cavity within the bore is defined by the insulator end and the plasma initiation point. In a further embodiment according to the present invention, the first and second electrodes are coaxial to each other along the central axis.

In the case of a coaxial-type railplug, a first of the electrodes or rails is hollow and forms a wall surface of the plug, and the other electrode is mounted within the first electrode in a coaxial, spaced and insulated relation. Gas or other combustible mixture is free to flow between the proximal and distal chambers, which may be interior to the second, center electrode, or exterior to the center electrode and interior to the first, coaxial electrode. When the railplug ignites combustible gases or vapors in a combustion chamber, expanding gases in the combustion chamber are able to expand through the proximal chamber into the distal chamber. Pressure changes in the combustion chamber occasioned by the combustion as well as the engine itself (for example, a moving piston) cause the gases to flow and effect cooling of the railplug.

Expressed otherwise, a railplug of the present invention incorporates an extended chamber or cavity, either interior to or exterior to the center electrode in the coaxial railplug configuration.

Although the invention is described and is specifically beneficial for the coaxial railplug geometry, it may also be applied to the parallel rail geometry with an extended or second cavity located behind the plasma initiation point (i.e., away from the muzzle end and toward the insulator end) within the bore. Thus, in yet another preferred embodiment, the first and second electrodes extend substantially parallel to each other along the central axis.

One possible disadvantage of simply extending the cavity of the conventional railplug design is that it may enable plasma heated by the arc to expand backwards from the plasma initiation point into the extended or second cavity (backup) rather than accelerate down the rails toward the muzzle end of the bore and into the combustion chamber. Accordingly, the present invention also provides another design, comprising a hollow inner electrode rather than an extended chamber, which retains the forced convective cooling of the center electrode hot-spot without allowing excessive volume for rearward expansion of the arc heated plasma.

In yet another preferred embodiment according to the present invention, a cooled railgun ignition device for generating and injecting a high energy plasma jet into a combustion chamber is provided, which includes a hollow inner electrode having an open proximal or muzzle end and a closed distal end, and an outer electrode circumferentially surrounding the inner electrode and substantially coaxial to the inner electrode along a central axis. The outer electrode is spaced apart from the inner electrode and defines an annular bore between the inner and outer electrodes. The bore has a proximal or muzzle end and a distal or insulator end, and the plasma initiation point is located in the bore between the proximal end and the distal end. The hollow inner electrode preferably has an internal diameter that is greater at its distal end than at its proximal end so that it is internally flared at its closed end.

As with the prior art railplugs, it may be preferred that one of the electrodes be grounded for some applications. It is contemplated that the present invention works with either the grounded outer electrode configuration (as illustrated in FIGS. 2–2B) or the isolated outer electrode configuration (as illustrated in FIG. 1).

Advantages of the present invention will be further appreciated from the drawings and from the detailed description provided below.

BRIEF DESCRIPTION OF THE DRAWINGS

The herein described advantages and features of the present invention, as well as others which will become apparent, are attained and can be understood in more detail by reference to the following description and appended drawings, which form a part of this specification.

It is to be noted, however, that the appended drawings illustrate only exemplary embodiments of the invention and are therefore not to be considered limiting of its scope, for the invention may admit to other equally effective embodiments.

DETAILED DESCRIPTION OF THE PREFERRED EMBODIMENTS

Figure 3:
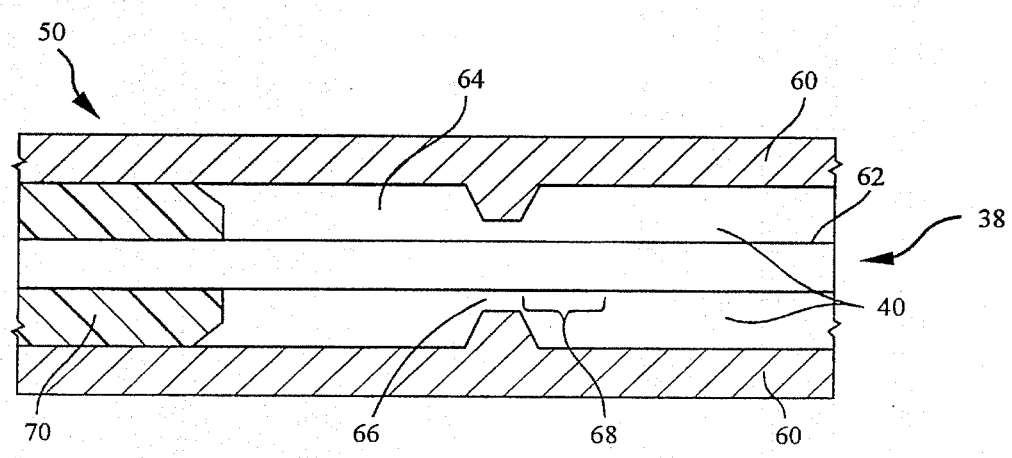
FIG. 3 is a cross-sectional view of a coaxial-rail cooled railplug with an extended cavity according to the present invention.

Turning now to the drawings, FIG. 3 is a cross-sectional view of a coaxial-rail cooled railplug with an extended cavity according to the present invention. Cooled railplug 50 comprises inner electrode 62, outer electrode 60, and insulator 70. An extended cavity 64 surrounds inner electrode 62 circumferentially behind plasma initiation point or zone 66 (away from muzzle end 38), and is defined in a space within bore 40 bounded by outer electrode 60, insulator 70, and plasma initiation point 66. The "hot spot" associated with the coaxial-rail railplug is indicated by 68, which is adjacent plasma initiation point 66.

In a typical application involving a railplug, as combustion chamber pressure increases due to the pumping action of a piston and/or the combustion process in an engine, gas and fuel vapor flows past the hot center electrode 62 and into extended cavity 64. In the process, heat is removed from center electrode 62 and transferred to outer electrode 60 and insulator 70. As cylinder pressure decreases, gas compressed in the extended cavity 64 flows back out of the railplug through muzzle end 38, removing even more heat in the process.

Figure 4:
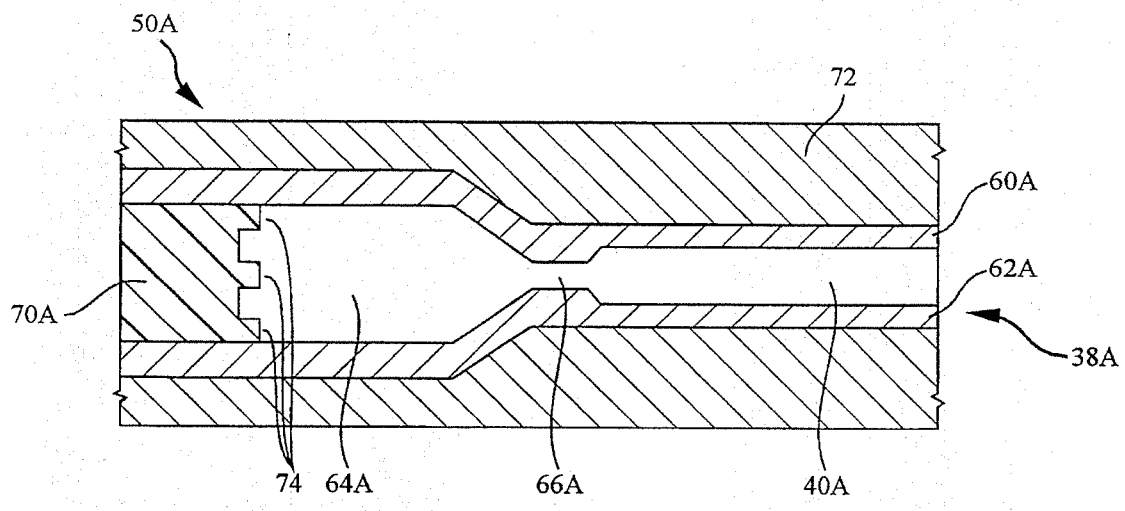
FIG. 4 is a cross-sectional view of a dual-rail cooled railplug with an extended cavity according to the present invention.

The parallel railgun design of the invention inherently has fewer problems with rail heating due to the contact between both electrodes and the insulator along the entire length of the electrodes. However, the above-described process may also be applied to the dual-rail (or parallel-rail) geometry as shown in FIG. 4. In FIG. 4, cooled railplug 50A comprises dual rails 60A and 62A. Extended cavity 64A within bore 40A is located behind plasma initiation point 66A (away from muzzle end 38A), and is defined by dual rails 60A, 62A within ceramic sleeve 72, insulator 70A, and plasma initiation point 66A. Protrusions 74, which may be surface convolutions on insulator 70A, may be incorporated to extend arc tracking length.

Figure 5:
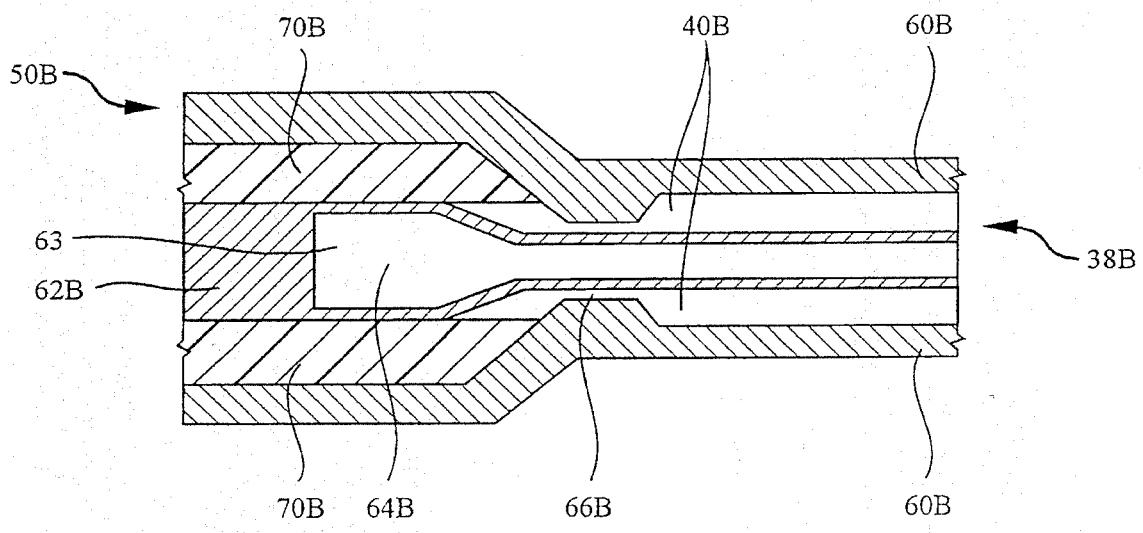
FIG. 5 is a cross-sectional view of a coaxial-rail railplug with a hollow center electrode according to the present invention.

One possible disadvantage of the configuration shown in FIG. 3 is that it may tend to enable plasma heated by the arc to expand into the extended cavity 64 rather than accelerate down the rails toward the combustion chamber (proximal or muzzle end 38). This problem may be approached or avoided by an alternative embodiment shown in FIG. 5. As shown in FIG. 5, cooled railplug 50B comprises hollow center electrode 62B, outer electrode 60B and insulator 70B. Instead of an extended or second cavity external to inner electrode 62B, the extended cavity 64B is incorporated within inner electrode 62B. Inner electrode 62B is shown in FIG. 5 as having a flared internal cross-section near its closed or distal end 63 (opposing proximal end 38B). Alternatively, inner electrode 62B may also be of constant cross-section or of a variety of other configurations that incorporate an enlarged interior cavity. This configuration retains the forced convective cooling of the center electrode in the manner described above, without allowing excessive volume for rearward expansion of the arc-heated plasma.

Figure 1:
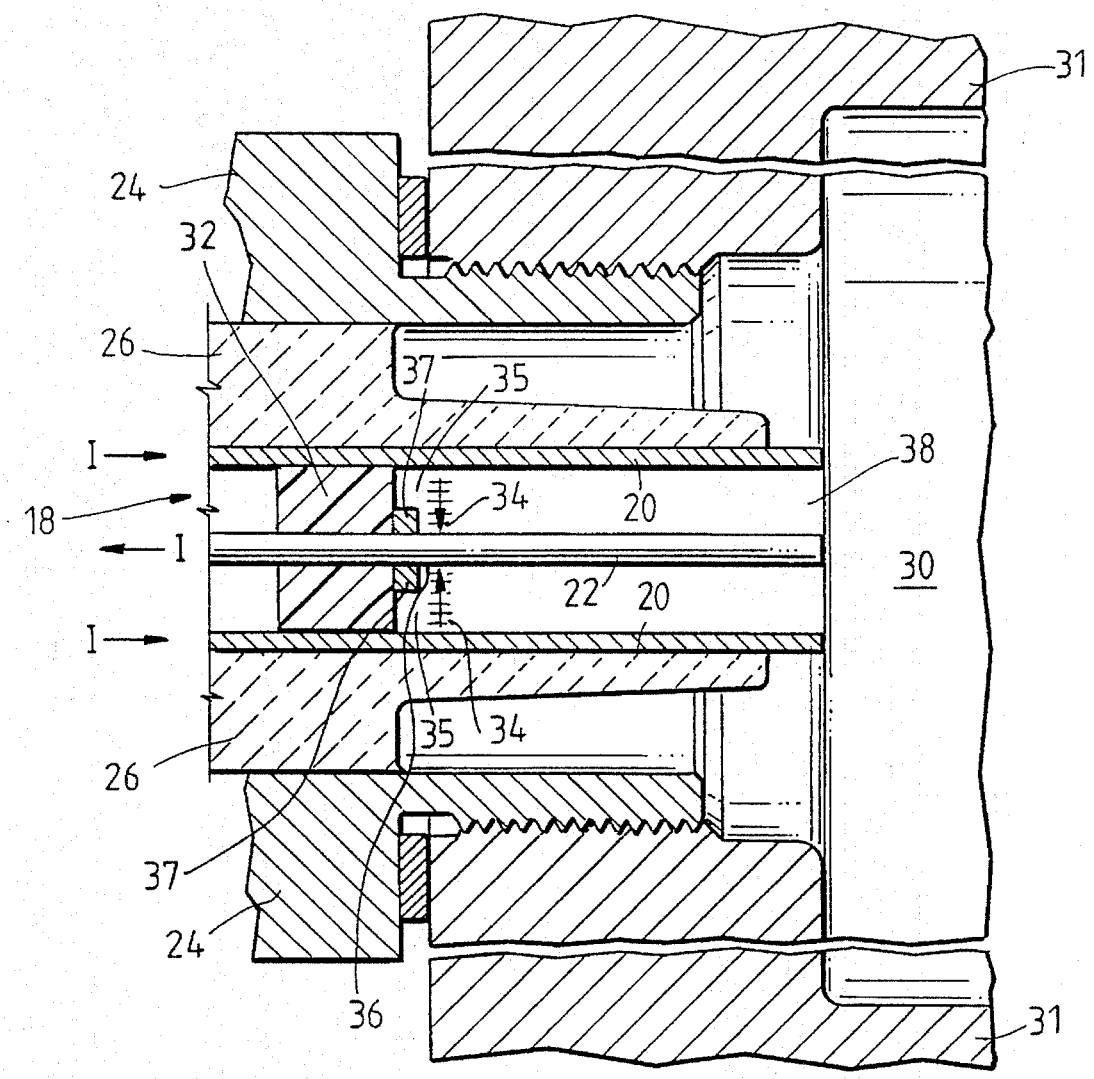
FIG. 1 is a cross-sectional view of a prior art coaxial-electrode railplug.
Figure 2:
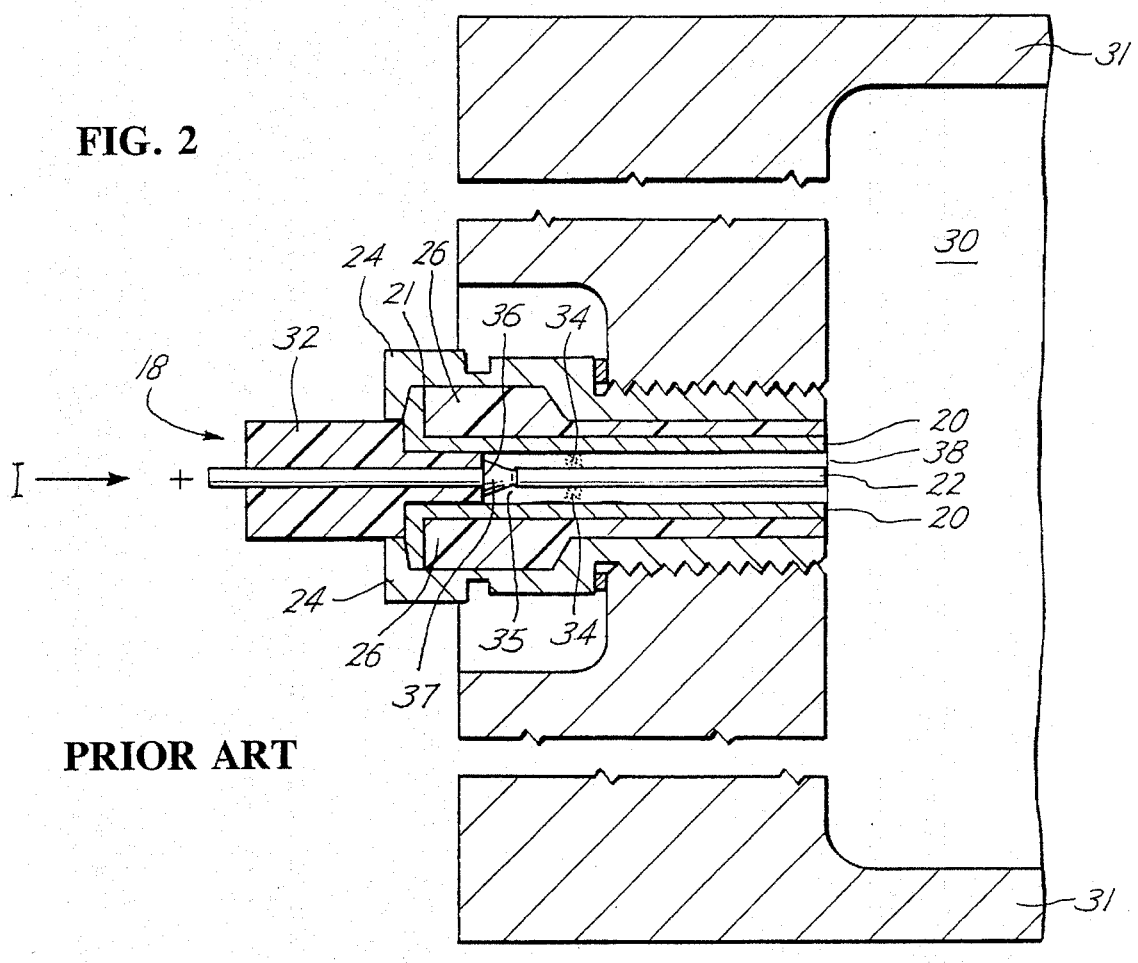
FIG. 2 is a cross-sectional view of a prior art coaxial-electrode railplug having a grounded outer electrode.
Figure 2A:
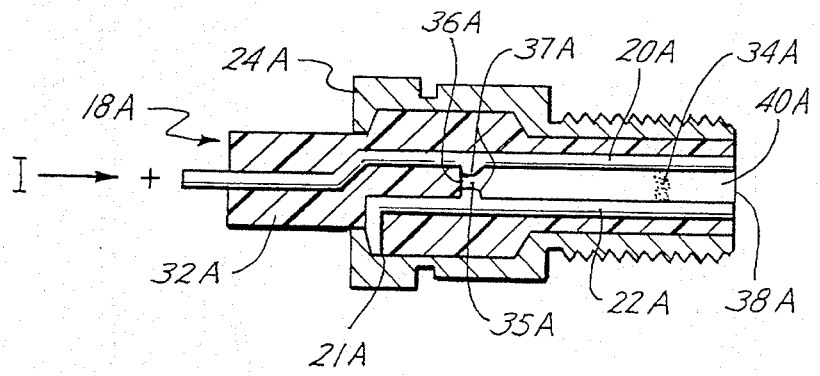
PRIOR ART FIG. 2A
FIG. 2A is a cross-sectional view of a prior art dual-rail railplug having a grounded electrode.
Figure 2B:
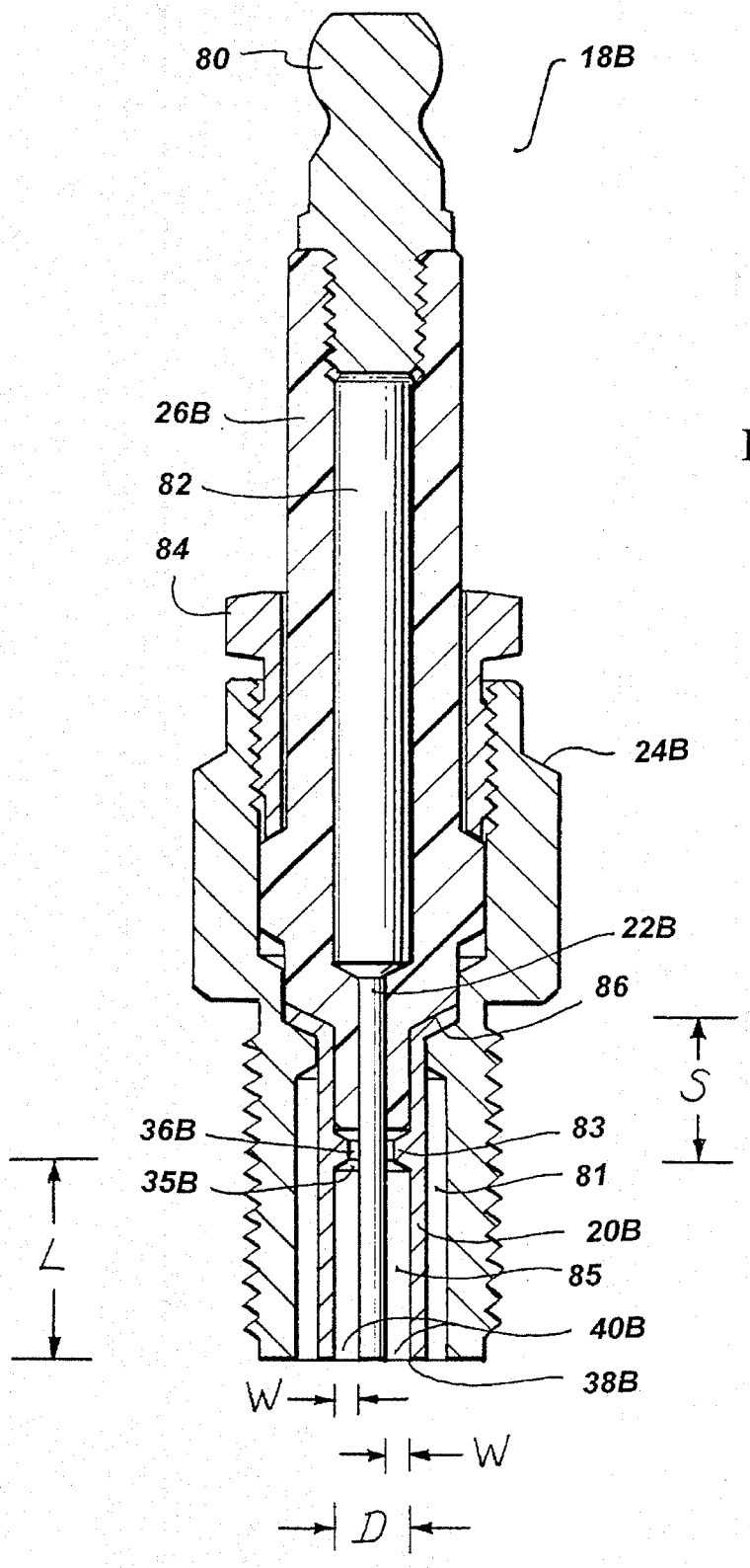
FIG. 2B PRIOR ART
FIG. 2B is a cross-sectional view of an alternative embodiment of a prior art coaxial-electrode railplug having a grounded outer electrode.

It will be apparent to one of skill in the art that the various embodiments of the present invention illustrated in FIGS. 3–5 may be adapted for grounded or nongrounded configurations, as illustrated in FIGS. 1–2B.

Figure 6:
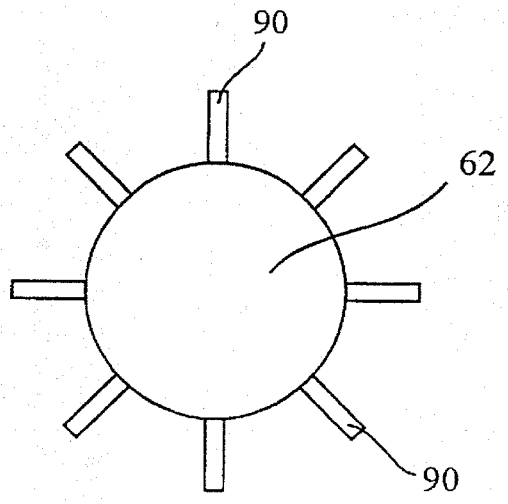
FIG. 6 is a front view of a center electrode of a coaxial-rail railplug with axial fins for enhanced heat transfer according to the present invention.
Figure 6A:
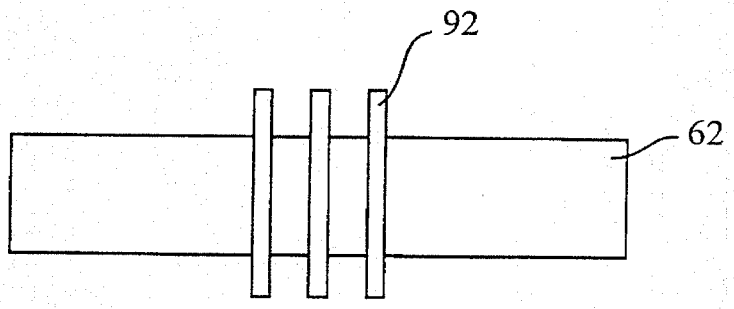
FIG. 6A is a side view of a center electrode of a coaxial-rail railplug with circumferential fins for enhanced heat transfer according to the present invention.
Figure 6B:
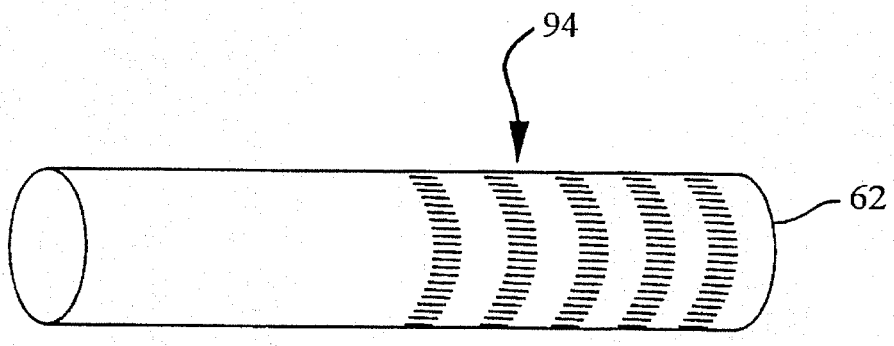
FIG. 6B is a side perspective view of a center electrode of a coaxial-rail railplug with toughened surface areas for enhanced heat transfer according to the present invention.

The process of transferring heat from the center electrode to the outer electrode in the coaxial embodiment of the present invention may be augmented by the usual techniques of fins, pins, and other methods of extending surface areas available for heat transfer. FIG. 6 is a front view of center electrode 62 of a coaxial-rail railplug with axial fins 90 for enhanced heat transfer according to the present invention. According to another aspect of the present invention, circumferential fins 92 may be coupled to center electrode 62, as shown in FIG. 6A, for enhanced heat transfer. As an alternative to adding pins or fins to center electrode 62, portions of the electrode itself may be roughened (such as by knurling or grit blasting the surface), as represented by toughened areas 94 shown in FIG. 6B. Other means of augmenting heat transfer from the center electrode will be apparent to those of skill in the art based on this disclosure.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

What is claimed is:

1. A railgun ignition device for generating and injecting a high energy plasma jet into a combustion chamber, comprising:

first and second spaced apart electrodes extending along a central axis and defining a bore having a proximal muzzle end and a distal insulator end;

an insulator disposed between said first and second electrodes at said insulator end;

a plasma initiation point located in said bore between said muzzle end and said distal end; and a first cavity within said bore defined by said muzzle end and said plasma initiation point; and a second cavity within said bore defined by said distal end and said plasma initiation point;

said first and second electrodes extending substantially parallel to each other along said central axis.

2. The railgun ignition device of claim 1, said distal end having surface convolutions facing said bore.

3. The railgun ignition device of claim 1, further comprising a holding plug for mounting said cooled railgun ignition device with its proximal end opening into a combustion chamber.

4. The railgun ignition device of claim 3, further comprising an electrical connection between said second electrode and said holding plug.

5. A railgun ignition device for generating and injecting a high energy plasma jet into a combustion chamber, comprising:

a hollow inner electrode having an open muzzle end and a closed end;

an outer electrode circumferentially surrounding said inner electrode and substantially coaxial with said inner electrode, said outer electrode spaced apart from said inner electrode and defining an annular bore between said inner and outer electrodes, said bore having a muzzle end and an insulator end; and a plasma initiation point located in said bore between and spaced apart from said muzzle end and said insulator end.

6. The railgun ignition device of claim 5, wherein an internal diameter of said hollow inner electrode is greater at its closed end, such that said hollow inner electrode is flared internally.

7. The railgun ignition device of claim 5, further comprising a holding plug adapted to mount said railgun ignition device on an internal combustion engine so as to discharge plasma in a combustion chamber of said engine.

8. The railgun ignition device of claim 7, further comprising an electrical connection between said second electrode and said holding plug.

9. The railgun ignition device of claim 5, said inner electrode having means for augmenting heat transfer from said inner electrode to said outer electrode.

10. A railgun plasma ignitor for an internal combustion engine, comprising:

first and second axially aligned chambers connected end-to-end, wherein said first chamber is open at its free end to receive gases from and expel gases to a combustion chamber of said engine and wherein said second chamber is closed at its free end;

a first rail extending along and forming at least a portion of the inner surface of both said chambers;

a second rail insulated from said first rail and extending along the two chambers in spaced relation with the first electrode; and a restricted hot spot zone positioned between the two chambers operable to restrict the flow of gas between the chambers.

11. A railgun ignition device for generating and injecting a high energy plasma jet into a combustion chamber, comprising:

first and second spaced-apart, coaxial electrodes extending along a central axis and defining a bore having a proximal muzzle end and a distal insulator end;

a plasma initiation point located in said bore between said muzzle end and said distal end; and a first cavity within said bore defined by said muzzle end and said plasma initiation point; and a second cavity within said bore defined by said distal end and said plasma initiation point.

12. The railgun ignition device of claim 11, said second electrode being substantially surrounded by said first electrode and having means for augmenting heat transfer from said second electrode to said first electrode.

* * * * *